United States Patent [19]

Ebeling

[11] Patent Number: 4,892,161

[45] Date of Patent: Jan. 9, 1990

[54] ROTARY ROCK DRILLING MACHINE

[75] Inventor: Wolfgang Ebeling, Hanover, Fed. Rep. of Germany

[73] Assignee: Turmag Turbo-Maschinen-AG Nüssel & Gräfer, Sprockhövel, Fed. Rep. of Germany

[21] Appl. No.: 286,385

[22] Filed: Dec. 19, 1988

[30] Foreign Application Priority Data

Dec. 23, 1987 [DE] Fed. Rep. of Germany ..... 3743706

[51] Int. Cl.[4] ..... E21B 17/046; E21B 19/16; E21C 1/00; E21C 11/00

[52] U.S. Cl. ..... 175/195; 166/77.5; 166/78; 166/85; 175/220; 175/323; 403/322; 403/328

[58] Field of Search ..... 166/77.5, 85, 78, 378, 166/379, 380; 175/122, 121, 162, 323, 195, 220; 403/322, 324, 328, 316; 81/57.33, 57.15, 57.16

[56] References Cited

U.S. PATENT DOCUMENTS

| | | | |
|---|---|---|---|
| 3,685,865 | 8/1972 | Young | 403/328 X |
| 3,698,768 | 10/1972 | Delli-Gatti | 403/322 X |
| 4,021,126 | 5/1977 | Deeter et al. | 403/322 X |

FOREIGN PATENT DOCUMENTS

| | | |
|---|---|---|
| 2654748 | 6/1978 | Fed. Rep. of Germany . |
| 2733028 | 2/1979 | Fed. Rep. of Germany . |
| 2834151 | 2/1980 | Fed. Rep. of Germany . |

*Primary Examiner*—Stephen J. Novosad
*Attorney, Agent, or Firm*—Michael J. Striker

[57] ABSTRACT

A rotary rock drilling machine comprises a carriage having two ends, a rotary drilling drive arranged longitudinally displaceable on the carriage, a guiding head arranged on one end of the carriage, the guiding head and the rotary drilling drive defining a longitudinal axis of the machine, a drilling rod composed of a plurality of drilling rod parts which are releasably connected with one another, the drilling rod parts having a plurality of screw convolutions, the drilling rod parts having one end having a coupling pin with a snap pin and another end having a coupling bush with an engaging opening for the snap pin, a positioning device in the guiding head arranged to arrest a rotary position of the drilling rod, and an unlocking device for the snap pin, the positioning device including a locking bar which extends substantially parallel to the longitudinal axis and displaceable radially to the drilling rod, and which is insertable in at least one radial slot provided in the screw convolution of the drilling rod.

28 Claims, 3 Drawing Sheets

ROTARY ROCK DRILLING MACHINE

BACKGROUND OF THE INVENTION

The present invention relates to a rotary rock drilling machine, especially for expansion drilling. More particularly, it relates to a rotary rock drilling machine which has a carriage, a rotary drilling drive arranged longitudinally displaceably on the carriage, a guiding head for a drilling rod on a head end of the carriage, and a screw drilling rod composed of a plurality of releasably connectable drilling rod parts. The drilling rod parts have a multi-cornered coupling pin with a snap pin on one hand and a multi-cornered coupling bush with an engaging opening for the snap pin on the other hand. In the guiding head a positioning device is arranged for arresting the rotary position of the drilling rod, and an unlocking device is provided for the snap pin.

Rotary rock drilling machines of the above mentioned general type are known in the art. One of such rotary rock drilling machines is disclosed in the German document DE-OS 2,834,151. Here the positioning device is shown in FIG. 4 in connection with FIG. 1 and formed as a relatively light pin which is welded on the drilling rod and cooperates with a turnable-in abutment in the guiding head. As long as the pin is located completely in engagement and contact with the abutment, the unlocking device can be turned into operation and the snap pin for separating the coupling pin of one drilling rod part from the coupling bush of another drilling rod part is displaced. This positioning device, in addition to the danger of a return springing of the pin from the abutment, possesses the disadvantage in that the wide-surface pin hinders the rock movement between both neighboring convolutions, thereby reduces important transporting output of the drilling rod in the expansion drilling machine. Moreover, there are also difficulties in that the turned-in abutment can collide with the rotatable screw convolutions. This disadvantage was recognized by the applicant and he removed the convolutions located near the pin, which undesirably affects the continuity of the rock transportation.

In the second alternative shown in FIG. 7 of the above mentioned patent, in a kinematic reverse the pin is arranged on the guiding head of the rotary rock drilling machine while the abutment is formed by a restoring spring which considerably reduces the cross-section of the coupling bush. The restoring spring of the coupling bush reduces the effective required cross-section for the torque transmission so dramatically that a breakage is unavoidable. This is true especially for the tendency of increasing the drive output double or triple the conventional drive outputs in the known expansion drilling machines which are characterized for this field. This embodiment is not suitable for transmitting such torques.

The German document DE-OS 2,733,028 discloses an arrangement on a rotary rock drilling machine with an unlocking device for the rear snap pin, which is placed into the drive pin and actuated by a fluid-operated piston arranged in it or in the drive shaft. This complicated unlocking device has the disadvantage of using pressure fluid supply in the drive shaft. Correspondingly it is susceptible to disturbances. Moreover, this system is not suitable for drilling machines which frequently required supply of a drilling rinsing through the drive shaft.

Finally, another expansion drilling machine is disclosed in the German document DE-PS 2,654,748. In this machine an undesirable rotation of the drilling drive is prevented in that an abutment is pressed by a cylinder against a "surface" of the drilling motor-insertion end. The "surface" here is a flattening of the round collar on the rear end of the insertion end. Such an arresting can prevent an undesirable rotation, however, it cannot hold the rotary drilling drive in the rotary position which is definite for the coupling and unlocking steps. This patent does not disclose how the turning-in or driving-in of the insertion end and the whole drilling strand can be brought in the accurate rotary angular position. An unlocking assumes always an exact positioning, since otherwise the unlocking arrangement can not be turned into operation.

The known expansion drilling machines exhibit the attempts to mechanize the adjustment process of the drilling rods and possibly to automate the same. In every case only partial results are achieved. In particular, the reaching of the rotary position of the drilling drive or the drilling rod strand was not mechanized at all or mechanized only with disadvantages for the feed capacity and for relatively weak drives. The last mentioned point is especially grave since the drive outputs and torques are increased in the expansion drilling machines up to 2–3 times. Moreover, expansion drilling machines are predominantly driven by pressure air motors which have massive rotors rotating at high speeds and are especially difficult to brake.

SUMMARY OF THE INVENTION

Accordingly, it is an object of the present invention to provide a rotary rock drilling machine which avoids the disadvantages of the prior art.

More particularly, it is an object of the present invention to provide a rotary rock drilling machine which maintains the conventional snap pin principle and at the same time provides automation of rough drilling operations with exactly in time-savingly operating robust positioning device in combination with the unlocking device. Thereby a decisive presumption for the automation of the blasting process is achieved. Drilling machines of this type drill predominantly in soft rocks and as a result with high drill displacements. The time intervals for the adjustment are therefore very costly so that its automation is especially advantageous. In addition, there is the danger during the expansion drilling because of rock impacts and gas breakages which make desirable remote control of the respective drilling processes. Until now, the adjustment of the drilling rods has been always performed manually which does not eliminate respective dangers.

The above mentioned objects and others which will become apparent hereinafter, are achieved in a rotary rock drilling machine which has a positioning device including a locking bar extending parallel to the longitudinal axis of the carriage displaceable radially as well as insertable into at least one radial slot provided in screw convolutions of the drilling rod parts. When the positioning device is designed in accordance with the present invention, an exact orientation of the respective drilling rod and its snap pin relative to the locking device is possible Since the locking bar of the positioning device engages at a maximum radial distance from the axis of symmetry of the drilling rod, an orientation with an accuracy and loading resistance is possible, which was not possible with the positioning devices formed in accordance with the prior art, for example in the German document DE-OS 2,834,151 because of the small radius. A return springing of the drilling rod from the achieved position is reliably prevented since the locking bar which engages in the radial slot blocks the drilling rod in both possible directions of rotation which is also not achieved in the prior art. Finally, interruption of the transporting screw in a convolution in the region of which drilling rod connection is avoided. The inventive positioning element which is the locking bar can be fixedly pressed against the rotatable drilling rod until it engages in the slot fast and reliably.

In accordance with another advantageous feature of the present invention, the locking bar has a length which at least corresponds to a convolution pitch of a drilling rod, so that the locking bar pressed against the screw convolutions can engage only in its slot. It is advantageous when the slots are provided in two neighboring screw convolutions at one end of the drilling rd at the same rotary angular position. In this construction the doubled thickness of the screw convolution can be used as an abutment surface.

It is however possible as always to provide only one radial slot in the screw convolution and in accordance with a preferable embodiment the radial slot can be formed at least in the region of a thickening of the respective screw convolution. In this case the thickening is dimensioned so that a deformation of the screw convolutions by the rotary pulse during braking of the rotary drilling drive does not occur.

In accordance with a further embodiment of the present invention, the engaging opening for the snap pin is located in a plane which extends through the slot and through the longitudinal axis of symmetry of the drilling rod. Thereby, it is possible to arrange in the locking bar of the positioning device simultaneously the locking device, to unite the same with the positioning device both structurally and functionally. Several embodiments are possible in this approach.

In accordance with a first advantageous embodiment, the engaging opening of the positioning device is located between two neighboring screw convolutions on the end of one drilling rod. In this case the engaging opening for the snap pin and therefore also the locking device are arranged in the longitudinal axis of symmetry of the drilling rod before or behind the radial slot of the positioning device.

In this case a plunger can be arranged in the locking bar in the axis of the snap pin-engaging opening, so that after the arresting of the locking bar it extends from the latter and unlocks the snap pin.

The displacement of the drive of the plunger can be combined or united with the locking bar.

In accordance with another embodiment, the engaging opening for the snap pin is arranged in the radial extension of the slot in direction to the longitudinal axis of symmetry of the drilling rod. This embodiment requires a respective thickening in the region of the slot for receiving engaging opening for the snap pin.

In this second embodiment, the unlocking device includes advantageously a pressing pin which cooperates with the locking bar is inserted in the locking bar, as well as arranged on one end of the drilling rod and displaces radially to its longitudinal axis of symmetry. The pressing pin displaces the snap pin to a separating plane located between the outer wall of the coupling pin of one drilling rod and the inner wall of the engaging coupling bush of another drilling rod.

In order to guarantee a reliable and disturbance free unlocking and to prevent a tilting from its radial guiding axis, it is advantageous to guide the pressing pin at the bottom of the slot in a respective bearing bush which engages with a collar. At the site of the collar, the pressing pin is under the action of a pressure spring of the snap pin, so that it is brought directly in contact with it during insertion of the locking bar into the radial slot. In this arrangement the positioning step is simultaneously united with the locking step.

Such a combination of several functions in one working and control step corresponds exactly to the object of the automation, especially for expansion drilling machines. This allows programming in condition of explosion protection for only limited number of individual functions.

In order to insure the desired accuracy both of the positioning device and also the locking device coupled therewith, the shape of the slot in the respective screw convolution is of not insignificant importance. The slot can have for example a conical shape.

In accordance with a special embodiment, the slot in the plan view of the respective screw convolution is formed of a trapezoidal shape. The side edges of the slot are advantageously formed as sharp edges, to insure with a minimum play an exact orientation of the locking bar relative to the longitudinal axis of symmetry of the drilling rod.

For coupling the drilling rod, not only the drilling rod which is located in a drilling machine, but also the end of the drilling rod strand which extends out of the borehole must be centered The rotary rock drilling machines in question during the expansion drilling are often displaced from their exact axial orientation relative to the borehole as a result of strong reactions of the rock. Stationary guiding bushes or shells therefore are subjected during drilling to an enormous wear. During the expansion drilling dangerous spark generation can prevent them from being used. Frequently the conventional guiding shells are used only for drilling of the borehole and then removed and turned forwardly. In this case, for each coupling step the required centering must be performed manually by manually pressing the end of the drilling rod strand to the centered position.

In accordance with a further embodiment of the present invention, the guiding head is provided for centering with two guiding shells which correspond to the outer diameter of the drilling rods, the guiding shells are mounted on rockers with downwardly located turning axes so as to be turned outwardly by a predetermined angle. The rockers are provided with individual turning drives or with a common turning drive and a coupling connection. The turning drive can be formed with a fluid-operated piston. The guiding shells can be arranged so as to be movable not only to the clamping position in which they fix the drilling rod for the couplings, but also to the open position for a drilling start in which the drilling rod ends however are sufficiently centered.

The adjustment of the drilling rod during the drilling process is performed by a front unlocking device in the region of the driving head. When however the drilling rod drawing must be automated, a second rear unlocking device is required for separating the withdrawn drilling rod from the drilling drive. For this purpose a further radially displaceable locking bar is arranged at the front of the rotary drilling drive so as to follow with its driving element the longitudinal movements of the drilling drive. Advantageously this locking bar extends forwardly so that it engages in an associated slot of the drilling rod convolution when the drilling rod is inserted but not engaged by the drilling drive. Thereby an exact adjustment of the drilling rod ends for the rear coupling step is achieved.

In accordance with another advantageous feature of the present invention, a disc is arranged on the drive shaft of the rotary drilling drive behind the multi-cornered coupling pin fixedly with the driving shaft. It is also provided on its periphery with a slot in the longitudinal plane of the snap pin. The rear locking bar which is extended to the rear side of this disc engages outwardly in the screw convolution of the drilling rod in the slot of the disc. Thereby the rotary pulse for stopping the drilling drive is taken up by the disc. It does not load the multi-cornered coupling of the drilling rod and its screw convolution. Since the disc is wide and is made refractory or hardened, a robust, load-resistant arresting device is provided without additional actuating elements.

A cutout in the rear wall of the guiding head permits the displacement of the long rear locking bar in the frontmost position of the drilling drive. The rear locking bar with the aid of the disc can be pulled in this position during the most difficult rotary positioning in which the rotary drive must co-rotate under load with the whole drilling rod strand. For this purpose it is required that the front locking bar is turned back in another direction to the other side, for preventing a collision of both locking bars. The front locking bar therefore serves in addition to the unlocking of the front drilling rod coupling also for fixing rotary position of the drilling rod strand after the rear locking bar is withdrawn for unlocking the front end of removing drilling rod during drawing of the drilling rod strand. The rotary-pulse loaded insertion in the rotary position can therefore always be performed with the rear locking bar and the disc, without loading of the drilling rods.

As disclosed in the German document DE-PS 2,654,748, in such drilling machines it is conventional to bring the drilling rods to be adjusted by the rod magazine to the coupling position The big, alternatingly loadable magazine can be maintained exactly in this position with great difficulties or with increasing expenses. In consideration of this it is proposed to pull the rear locking bar for adjusting the adjusting bar. For extending such adjustment also for the front end of the adjusting bar, the guiding head of the rotary rod drilling machine is provided with two rearwardly extending holding bars which can be displaced forwardly during approaching of the rotary drilling drive so as not hinder its displacement. Holding bars are arranged so that the screw convolutions of the adjustment drilling rods abut against them in the coupling position. When the holding bars are arranged in the guiding shells and laterally turnable with them, they do not hinder the free movement of the drilling rod during drilling away from the center axis of the machine. This positioning aid directly on the rotary rock drilling machine together with the guiding head which mechanically centers the drilling rod strand is a very important help for the reliable automation of the coupling process.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
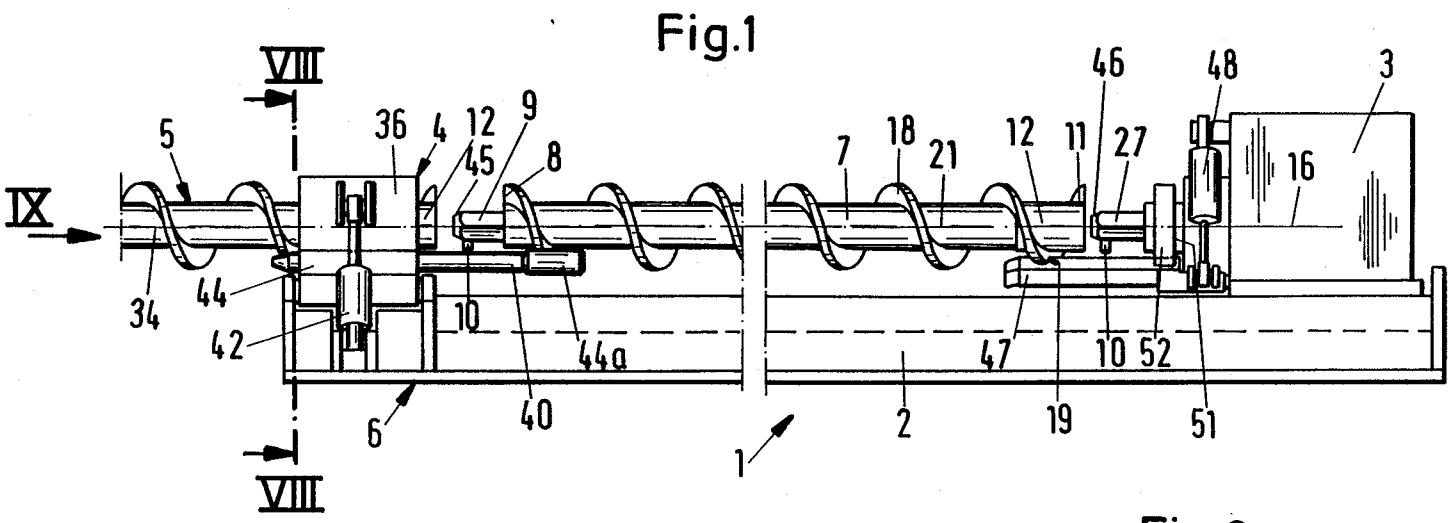
FIG. 1 is a side view of a rotary rock drilling machine in accordance with the present invention with a carriage, a rotary drilling drive which is longitudinally displaceable on the carriage, and a guiding head for a screw drilling rod in the position for displacing a drilling rod.

A rotary rock drilling machine in accordance with FIG. 1 is identified as a whole with reference numeral 1. It has a carriage 2, a rotary drilling drive which is arranged longitudinally displaceably on the carriage and a guiding head 4 for a drilling rod 5 at a head end 6 of the carriage. The screw drilling rod 5 is composed of several drilling rod parts which are releasably connected with one another. Its one end 8 is provided with a coupling pin 9 having a multi-cornered cross-section and a snap pin 10. Its other end 11 is provided with a coupling bush 12 which has a corresponding multi-cornered cross-section as shown in FIGS. 4 –7 and is provided with an engaging opening 13 for the snap pin 10 of the adjacent drilling rod member 7.

A positioning device 14 and an unlocking device 15 for the snap pin 10 are located on the guiding head 4 and on the rotary drilling drive 3 as shown in FIGS. 4 –7. The positioning device 14 and the unlocking device 15 are described hereinbelow.

In both shown embodiments the positioning device 14 includes a locking bar 17 which extends parallel to a longitudinal axis 16 of the rotary rock drilling machine and is displaceable radially to the drilling rod part 7. The locking bar 17 is insertable into at least one radial slot 19 which is arranged radially in a screw convolution 18. The longitudinal axis is formed by the connecting line between the center of the drive shaft 51 and the center of the guiding head 4. Its length L is at least equal to a screw convolution pitch I of the screw convolutions 18 of a drilling rod part 7. Thereby the locking bar which is pressed into the screw convolution 18 can be inserted only into the slot 19 and not into the intermediate space between two screw convolutions 18.

Figure 4:
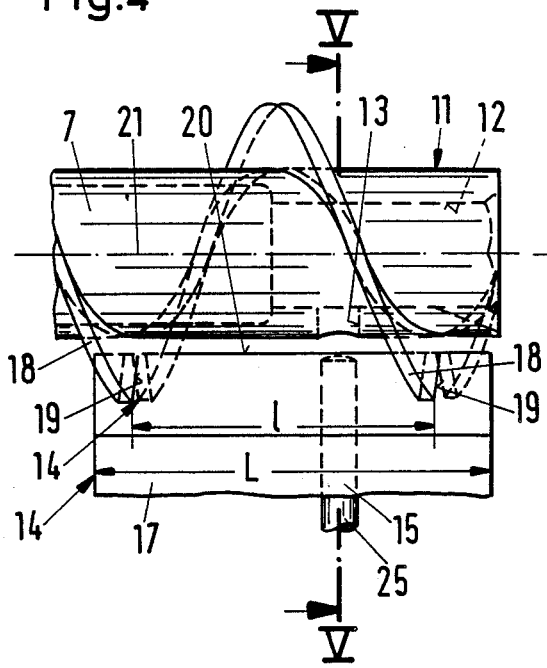
FIG. 4 is a side view of a locking bar of a positioning device with an unlocking plunger during engagement in two radial slots of two neighboring screw convolutions in not thickened design on the end of a drilling rod.
Figure 5:
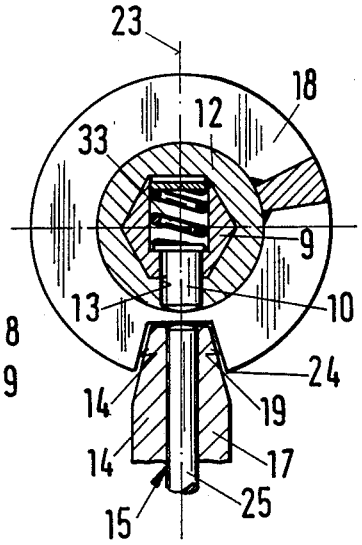
FIG. 5 is a view showing a section along the line V—V in FIG. 4 with additionally shown hexagonal coupling pin with a snap pin of the next drilling rod.

In accordance with a first embodiment shown in FIGS. 4 and 5, the radial slot 19 is provided in two neighboring screw convolutions 18 on the end of the drilling rod part 7 in the same rotary angular length. Their connecting line 20 which in the shown example must coincide with the front edge of the locking bar 17 extends substantially parallel to longitudinal axis of symmetry 21 of the drilling rod part 7. Thereby the doubled thickened of the screw convolution 18 is used as an abutment surface.

Figure 7:
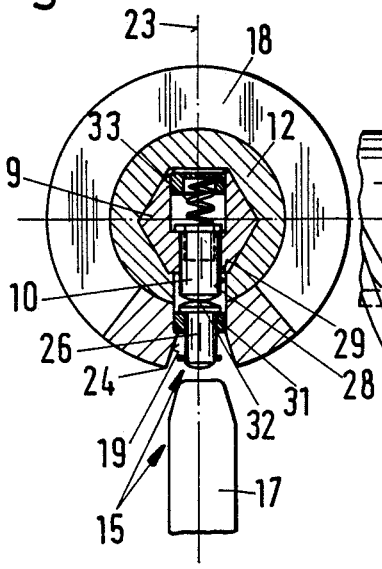
FIG. 7 is a section taken along the line VII—VII in FIG. 6, with locking bars which are arranged one behind the other and cooperating pressing pin for unlocking the snap pin of the additional hexagonal coupling pin of the next drilling rod.
Figure 6:
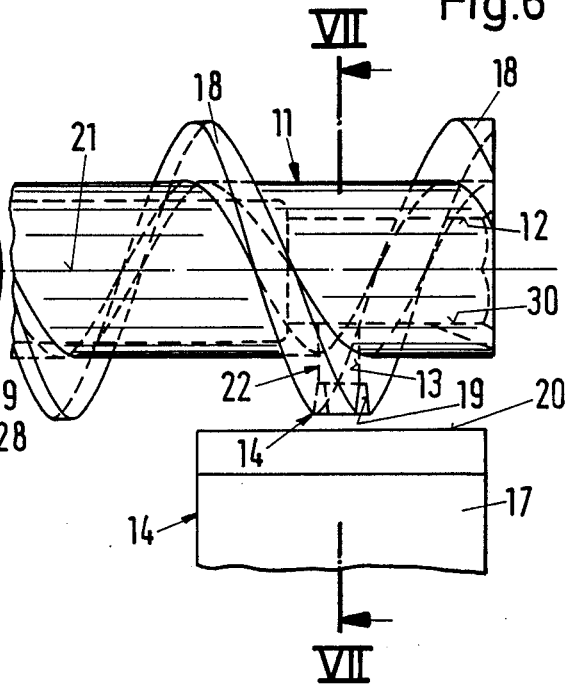
FIG. 6 is a side view of a locking bar of the positioning device before its engagement in a radial slot of a screw convolution which is thickened in this region.

In accordance with an advantageous second embodiment as shown in FIGS. 6 and 7, the screw convolution 18 which has the radial slot 19 is thickened at least in a region 22 of the slot 19. The thickening is dimensioned so that a deformation of the screw convolution 18 during the rotary impulse in the event of breaking of the rotary drilling drive 3 is prevented in any event.

In both embodiments of the positioning device in accordance with FIGS. 4 and 5 on the one hand, and FIGS. 6 and 7 on the other hand, the engaging openings 13 for the snap pin 19 lies in a plane which extends through the slot 19 and through the longitudinal axis of symmetry 21 of the drilling rod part 7.

In the embodiment of FIGS. 4 and 5, the engaging opening 13 is located between two neighboring screw convolutions 18 on the end 11 of the drilling rod part 7.

In the embodiment of FIGS. 6 and 7, to the contrary, the engaging opening 13 is located in a radial extension of the slot 19 in direction of the longitudinal axis of symmetry 21 of the drilling rod part 7. The slot 19 in FIGS. 5–7 has a conical, here a trapezoidal shape in the cross-section of the drilling rod part 7 in direction of its longitudinal axis of symmetry. End edges 24 of the slot 19 are formed advantageously as sharp edges.

The unlocking device 15 in the embodiment shown in FIGS. 4 and 5, includes a plunger 25. This plunger is arranged in the locking bar 17 and radially displaceable in direction to the longitudinal axis of symmetry 21 of the drilling rod part 7.

In accordance with the second embodiment of FIGS. 6 and 7, the unlocking device 15 includes a pressing bolt 26 which cooperates with the locking bar 17. The pressing bolt 26 is insertable by the locking bar 17, arranged at the respective end 11 of the drilling rod part 7 and displaceable in radial direction to its longitudinal axis of symmetry. The pressing bolt 26 displaces the snap pin 10 on the coupling pin 9 of the subsequent drive rod part 7, or the snap pin 10 on the coupling pin 27 of the rotary driven drive 3 to a separating plate located between an outer wall 28 of the coupling pin 9 of one drilling rod part 7 or the coupling pin 27 of the rotary drilling drive 3 and an inner wall 29 of the interengaging coupling bush 12 of another drilling rod part 7.

As can be seen from FIG. 7, the pressing bolt 26 is guided at the bottom of the slot 19 in a bearing bush 31. The latter engages with a collar 32 and at this side is arranged under the action of the pressure spring 33 through the snap pin 10.

In both embodiments of FIGS. 4, 5 on the one hand and FIGS. 6, 7 on the other hand, directly with the engagement of the locking bar 17 in the slot or slots 19 of the screw convolution 18, by actuation of the plunger 25 on the one hand and the pressing bolt 26 on the other hand, the unlocking of the snap pin 10 can start or the positioning and the unlocking can be performed simultaneously. Thereby, especially in the consideration of an automation of such rotary rock drilling machines, an exact and time-saving inventive combination of the positioning and unlocking device is provided.

Figure 8:
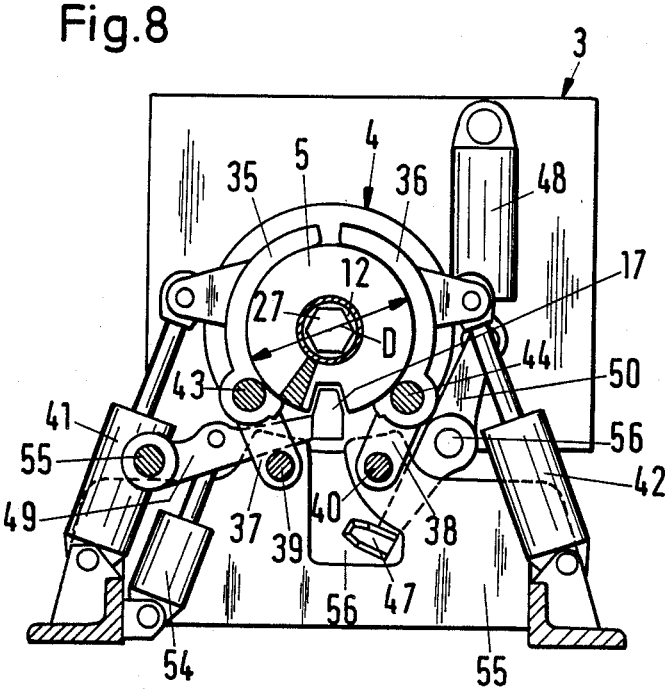
FIG. 8 is a section along the line VIII—VIII in FIG. 1 with closed guiding shells of the guiding head and a locking bar of the guiding head which engages in the slot of the screw convolution.
Figure 9:
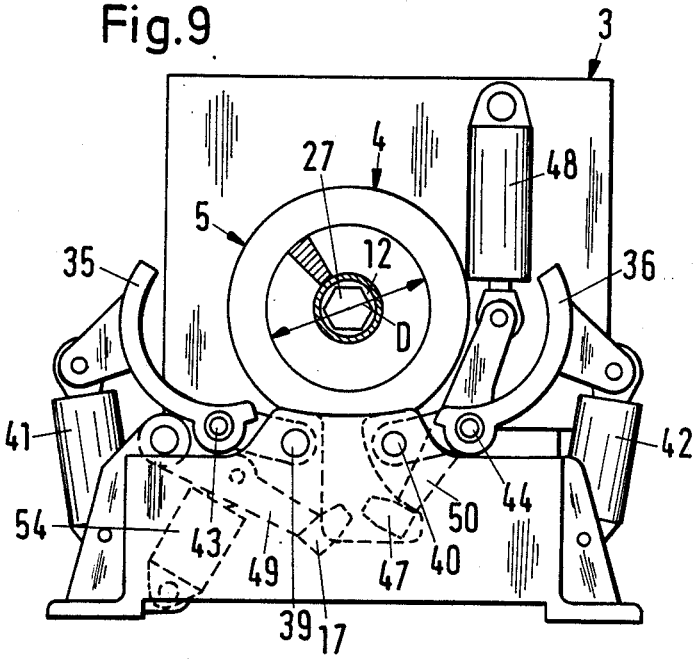
FIG. 9 is a view in direction of the arrow IX in FIG. 1 onto the drilling machine with section drilling rod with folded guiding shells, and turned away locking bars in the drilling position of the drilling rod.

The guiding head 4 performs a guidance for exact positioning of the free end of the drilling rod 5, especially when its axis of symmetry 34 in FIG. 1 does not coincide with the longitudinal axis 16 of the rotary rock drilling machine 1 of the subsequent drilling rod part 7 in a straight extension, but instead because of acting rock forces is located in an offset position In accordance with a further embodiment of the invention shown in FIGS. 8 and 9, the guiding head 4 includes guiding shells 35 and 36 which correspond to the outer diameter D of the drilling rod part 7. Each of the guiding shells 35 and 36 is mounted on a rocker 37 and 38 respectively which are turnable about deeply located turning axes 39 and 40 outwardly from the drilling rod part 7 by a predetermined angle. In the shown embodiment of FIGS. 8 and 9 each rocker 35, 36 is connected with a suitable turning drive 41 and 42, respectively in form of a fluid-operated cylinder-piston unit. It is also possible to actuate both rockers 35 and 36 through a multiple-link chain as a coupling member from a common turning drive 41 or 42.

Three positions are characteristic for the rockers 35 and 36. During coupling of the drilling rod 5 in accordance with FIG. 1 with a subsequent drilling rod part 7, a predetermined centering and clamping force is required to brought through the turning drive 41 and 42 for forcing the longitudinal axis of symmetry 34 of the drilling rod 5 in coaxial position to the longitudinal axis of symmetry 21 of the subsequent drilling rod part 7.

During drilling with the drilling rod part 7, the guiding shells 35 and 36 abut against the outer periphery of the drilling rod 5, however, without a clamping force.

During the drilling process itself the guiding shells 35 and 36 are turned to the position shown in FIG. 9. This is done for preventing a friction between the contact surfaces of the guiding shells 35 and 36 on the one hand, and the outer peripheral surfaces of the drilling rod 5 on the other hand, because of the thereby connected danger of spark shock in the underground excavations and to avoid undesirable wear.

In the above described second position during the drilling process it is especially advantageous when the guiding shells 35 and 36 are brought through the rockers 37 and 38 to a slightly open intermediate position which however sufficiently centers the drilling rod 5.

As can be seen clearly from FIGS. 8 and 9, holding rods 43 and 44 are supported by the rockers 37 and 38. They extend parallel to the longitudinal axis 16 of the rotary rock drilling machine 1 and touch with their thickened ends 44*a* shown in FIG. 1 the outer peripheral surface of a subsequent drilling rod part 7 in a turned position of the guiding shells 35 and 36 of FIG. 8. Thereby respective positioning of the drilling rods 7 at the rotary drilling drive 3 of the coupling pin 9 of this subsequent drilling rod 7 is possible without difficulties in the coupling bush 12 of the drilling rod 5 which is held in the guiding head 4. For this purpose in FIG. 1 a front end 45 of the coupling pin 9 is beveled in a conical fashion. The same is true for a front end 46 of the coupling pin 27 at the rotary drilling drive 3.

Figure 3:
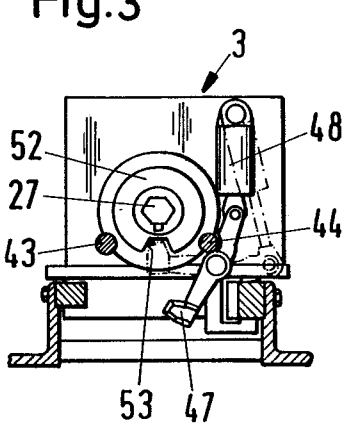
FIG. 3 is a view showing a section of the carriage taken along the line III—III of FIG. 2 as seen from the front of the rotary drilling drive.
Figure 2:
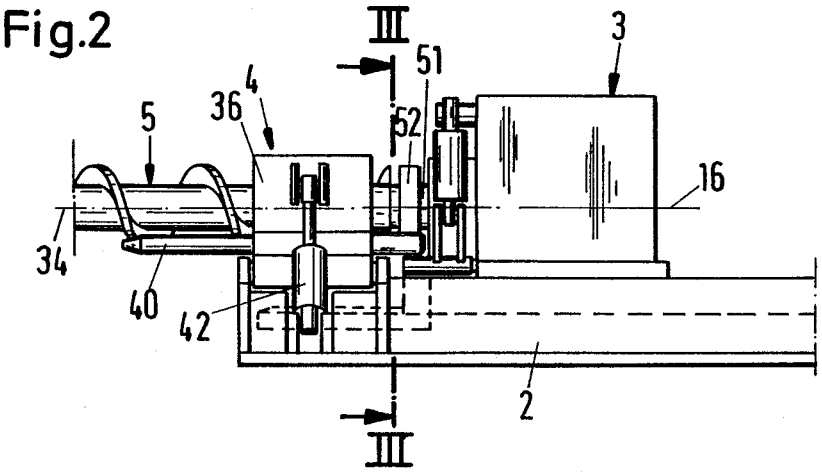
FIG. 2 is a side view of a front part of the same drilling machine with the rotary drilling drive in the frontmost position.

As can be seen from FIGS. 8 and 9 in connection with FIGS. 1–3, in addition to the positioning device 14 on the guiding head 4, a second positioning device in the rotary drilling drive 3 is provided. This positioning device includes also a radially displaceable locking bar 47 which is turnable by an actuating unit 48. The latter is mounted in the rotary drilling drive 3 and formed as a fluid-operated cylinder-piston unit. The locking bar 46 on the rotary drilling drive 3 is exactly oriented in inserted position relative to the same rotary angular position of the locking bar 17 on the guiding head 4. Both locking bars 17 and 47 are coupled through two-armed levers 49 and 50 with their actuating elements 54 and 48 and turnable about the stationary axes 55 and 56 respectively.

As can be seen from FIGS. 1–3, a disc 52 is located in a rotation-fixed manner on the drive shaft 51 of the rotary drilling drive 3 behind its coupling pin 27. The disc is provided with a slot 53 which corresponds to the locking bar 47 and lies in the longitudinal plane of the snap pin 10. The slot 53 corresponds to the slot 19 of the screw convolution 18 of the drilling rod part 7. Thereby the torque of the pressure air motor of the rotary drilling drive 3 can be taken up during engagement of the locking bar 47 in the slot 53, and the rotation of the drive shaft 51 can be braked to zero. This is especially recommended when the rotary drilling drive 3 in accordance with FIG. 2 after the drilling locates a drilling rod in its frontmost position and it is further rotated under load of the drilling rod 5 until arresting in the coupling position. This is connected with the maximum rotary pulses which must be absorbed by the disc 52 and possibly not by the last drilling rod. For permitting actuation of the rear locking bar 47 also in this position of the rotary drilling drive 3, a recess 56 is provided in a rear wall 55 of the guiding head 4. The locking bar 47 can be moved into the recess 56 as long as the front locking part 17 is blocked in the extended immovable position.

After unlocking the snap pin and fixing the drilling rod end 5 by means of the guiding shells 35 and 36, the rotary drilling drive 3 is withdrawn back to its rearmost position of FIG. 1, and the following drilling rod part 7 is inserted into the rotary rock drilling machine 1. For maintaining the position of the subsequent drilling rod part 7 by the rotary rock drilling machine 1 itself, placing devices are provided in accordance with the invention for both ends. The rear placing device includes the rear locking bar 47 which extends forwardly to the subsequent drilling rod 7 in the radial slot 19 for simultaneously fixing the rotary position of the subsequent drilling rod part 7. The front placing device includes the holding rods 43 and 44. The placing devices arranged at the sides of the drilling machine are designed for avoiding the expenses for the structure and programming of the not shown drilling rod magazine or its drilling rod manipulator. The holding rods 43 and 44 are longitudinally displaceable forwardly so that they can be placed by the adjacent rotary drilling drive 3 instead of hindering it as can be seen in FIG. 2. During the withdrawal of the rotary drilling drive 3 they are displaced back for example by not shown restoring spring elements to the initial position shown in FIG. 1.

For displacing back of the rotary drilling drive 3, the front locking bar 17 in addition to the clamping force of the guiding shells 35 and 36, can take over the fixation of the rotary position of the end of the drilling rod 5 as shown in FIG. 8.

After insertion of the drilling rod 7 in accordance with FIG. 1, its both ends are coupled in a simple manner by pulling forwardly of the rotary drilling drive 3.

The rod drawing is first unlocked by the locking bar 17 of the front snap pin 10 of the last drilling rod, the rod is then pulled from the rotary drilling drive 3 to the position of the drilling rod part 7 shown in FIG. 1, and in this position engage by a magazine or a manipulator. Then, the locking bar 47 unlocks the snap pin 10 of the coupling pin 27 and the rotary drilling drive 3 moves to is rear end position. After this a free drilling rod part 7 is removed.

It is to be understood that the above discussed rotary rock drilling machine 1 can be provided with new or known rotary drilling part magazines for use in a fully automatic fashion.

It will be understood that each of the elements described above, or two or more together, may also find a useful application in other types of constructions differing from the types described above.

While the invention has been illustrated and described as embodied in an automatable rotary rock drilling machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A rotary rock drilling machine, comprising a carriage having two ends; a rotary drilling drive arranged longitudinally displaceable on said carriage; a guiding head arranged on one end of said carriage, said guiding head and said rotary drilling drive defining a longitudinal axis of the machine; a drilling rod composed of a plurality of drilling rod parts which are releasably connected with one another, said drilling rod parts having a plurality of screw convolutions, said drilling rod parts having one end having a coupling pin with a snap pin and another end having a coupling bush with an engaging opening for said snap pin; a positioning device in said guiding head arranged to arrest a rotary position of said drilling rod; and an unlocking device for said snap pin, said positioning device including a locking bar which extends substantially parallel to said longitudinal axis and displaceable radially to said drilling rod, and which is insertable in at least one radial slot provided in said screw convolution of said drilling rod.

2. A rotary rock drilling machine as defined in claim 1, wherein said coupling pin has a multi-cornered cross-section, said engaging opening of said coupling bush having a multi-cornered cross-section corresponding to the cross-section of said coupling pin.

3. A rotary rock drilling machine as defined in claim 1, wherein said screw convolutions have a predetermined pitch therebetween, said locking bar having a length which at least corresponds to said pitch of said screw convolutions.

4. A rotary rock drilling machine as defined in claim 1, wherein two of said screw convolutions are provided on an end of said drilling rod part each having a radial slot, said slot being arranged in a same rotary angular position.

5. A rotary rock drilling machine as defined in claim 1, wherein said screw convolution which is provided with said radial slot is thickened at least in the region of said slot.

6. A rotary rock drilling machine as defined in claim 1, wherein said drilling rod part has a longitudinal axis of symmetry, said engaging opening for said snap pin lying in a plane which extends through said slot and through said longitudinal axis of symmetry of said drilling rod part.

7. A rotary rock drilling machine as defined in claim 1, wherein said engaging opening is located between two neighboring ones of said screw convolutions on an end of said drilling rod part.

8. A rotary rock drilling machine as defined in claim 1, wherein said drilling rod part has a longitudinal axis of symmetry, said engaging opening being arranged in a radial extension of said slot in direction to said longitudinal axis of symmetry.

9. A rotary rock drilling machine as defined in claim 1, wherein said drilling part has a longitudinal axis of symmetry, said slot has in a cross-section of said drilling rod part a conical shape in direction toward said longitudinal axis of symmetry.

10. A rotary rock drilling machine as defined in claim 1, wherein said drilling rod part has a longitudinal axis of symmetry, said slot having a shape in a cross-section of said drilling rod part which is trapezoidal in direction toward said longitudinal axis of symmetry.

11. A rotary rock drilling machine as defined in claim 1, wherein said slot has side edges which are formed as sharp edges.

12. A rotary rock drilling machine as defined in claim 1, wherein said drilling rod part has a longitudinal axis of symmetry, said unlocking device has a plunger which is arranged in said locking bar and is displaceable radially in direction to said longitudinal axis of symmetry.

13. A rotary rock drilling machine as defined in claim 1, wherein said drilling rod part has a longitudinal axis of symmetry, said unlocking device having a pressing pin which cooperates with said locking bar and is insertable by said locking bar as well as arranged on an end of said drilling rod part and displaceable in a radial direction relative to said axis of symmetry, said coupling pin having an outer wall and said coupling bush having an inner wall, said pressing pin being arrange to displace said snap pin with separating plane located between said outer wall of said coupling pin of one of said drilling rod parts and said inner wall of said coupling bush of another of said drilling rod parts.

14. A rotary rock drilling machine as defined in claim 13; and further comprising a bearing bush located at a bottom of said slot, said pressing pin being guided in said bush having a collar engaging with the latter, said snap pin having a pressure spring acting upon said pressing pin.

15. A rotary rock drilling machine as defined in claim 1, wherein said guiding head has two guiding shells corresponding to an outer diameter of said drilling rod parts; and further comprising two rockers each arranged to support a respective one of said guiding shells turnably about a turning axle over a predetermined angle.

16. A rotary rock drilling machine as defined in claim 15; and further comprising a turning drive for turning said rockers.

17. A rotary rock drilling machine as defined in claim 16, wherein said turning drive includes a fluid-operated cylinder-piston unit.

18. A rotary rock drilling machine as defined in claim 16, wherein each of said rockers is provided with one such turning drive.

19. A rotary rock drilling machine as defined in claim 16, wherein both said rockers are provided with a common turning drive and a coupling member for connecting said rockers with one another.

20. A rotary rock drilling machine as defined in claim 15, wherein said guiding shells are arranged to be movable between a first position in which said guiding shells clampingly fixedly retain said drilling rod and another position in which said guiding shells are slightly open and at the same time they center a respective one of said drilling rod parts.

21. A rotary rock drilling machine as defined in claim 1; and further comprising means for positioning a subsequent drilling rod part and including a second radially displaceable locking bar with an actuating element on a front side of said rotary drilling drive, said second locking bar in an inserted position being located in the same rotary angular position as said first mentioned locking bar in said guiding head.

22. A rotary rock drilling machine as defined in claim 21, wherein said rotary drilling drive has a drive shaft provided with a disc which is fixedly arranged on said drive shaft and located behind said coupling pin, said disc being provided with a further slot which corresponds to said first mentioned slot in said screw convolution.

23. A rotary rock drilling machine as defined in claim 22, wherein said second-mentioned locking bar of said rotary drilling drive extends up to a rear side of said disc.

24. A rotary rock drilling machine as defined in claim 1, wherein said guiding head has two holding bars which extend in a direction to said rotary drilling drive until abutment against a subsequent drilling rod part.

25. A rotary rock drilling machine as defined in claim 21, wherein said second mentioned locking bar extends forwardly so that it reaches said first mentioned radial slot of a subsequent non-coupled one of said drilling rod parts.

26. A rotary rock drilling machine as defined in claim 24, wherein said holding rods are displaceable under the action of a force of said rotary drilling drive and under the action of a spring force during departing of said rotary drilling drive to its initial position.

27. A rotary rock drilling machine as defined in claim 26; and further comprising spring means for providing said spring force acting upon said holding rods.

28. A rotary rock drilling machine as defined in claim 24, wherein said guiding head includes two guiding shells corresponding to an outer diameter of said drilling rod parts turnable about pivot axes, said holding bars being supported in said guiding shells and turnable together with the latter.

* * * * *